US005706253A

United States Patent [19]

Nedderman, Jr.

[11] Patent Number: 5,706,253

[45] Date of Patent: Jan. 6, 1998

[54] ACOUSTIC RECEIVER ARRAY ASSEMBLY

[75] Inventor: William H. Nedderman, Jr., Middletown, R.I.

[73] Assignee: The United States of America as represented by the Secretary of the Navy, Washington, D.C.

[21] Appl. No.: 640,579

[22] Filed: Apr. 28, 1996

[51] Int. Cl.[6] ..... H04R 17/00

[52] U.S. Cl. ..... 367/153; 367/173

[58] Field of Search ..... 367/153, 173

[56] References Cited

U.S. PATENT DOCUMENTS

| | | | |
|---|---|---|---|
| 3,145,679 | 8/1964 | Brooks | 114/23 |
| 3,566,346 | 2/1971 | Scopatz | 367/153 |
| 3,886,491 | 5/1975 | Jonkey et al. | 367/153 |
| 4,449,211 | 5/1984 | Schmidt et al. | 367/153 |
| 5,091,892 | 2/1992 | Secretan | 367/153 |
| 5,363,343 | 11/1994 | Klein | 367/173 |

*Primary Examiner*—Ian J. Lobo

*Attorney, Agent, or Firm*—Michael J. McGowan; James M. Kasischke; Prithvi C. Lall

[57] ABSTRACT

An acoustic receiver array assembly includes an underwater vehicle having a base portion and an acoustic receiver portion. The base portion is provided with a rigid boundary wall defining a first largest diameter. The receiver portion is provided with a flexible boundary wall expandable from a generally cylindrical configuration of no more than the first diameter to an expanded configuration of a second diameter substantially larger than the first diameter, the receiver portion defining a chamber. Expansion means is disposed in the chamber and is operable to expand the receiver portion boundary wall to the second diameter. Acoustic receivers are mounted in the receiver portion and provide an acoustic receiver array which expands commensurately with the expansion of the receiver portion boundary wall.

7 Claims, 2 Drawing Sheets

ACOUSTIC RECEIVER ARRAY ASSEMBLY

STATEMENT OF GOVERNMENT INTEREST

The invention described herein may be manufactured and used by or for the Government of the United States of America for governmental purposes without the payment of royalties thereon or therefor.

BACKGROUND OF THE INVENTION (1) Field of the Invention

The invention relates to underwater acoustic receiver arrays and is directed more particularly to a submarine torpedo tube launched receiver array assembly wherein the array is adapted to expand to provide a larger diameter array than current arrays of similar type.

(2) Description of the Prior Art

Sonar arrays are often deployed on an unmanned undersea vehicle (UUV) that can be launched by way of submarine torpedo tubes. The torpedo tubes of virtually all of the active submarines of the United States are sized to launch torpedoes having a diameter of 21 inches. Thus, the torpedo tubes are provided with a diameter of slightly greater than 21 inches. Accordingly, bodies other than torpedoes, such as UUVs, are limited by the constrictions of the torpedo tubes to having a diameter of no greater than 21 inches. While a 21 inch UUV is suitable for launch from a submarine, the limitation of the vehicle diameter to 21 inches severely limits the accuracy of the acoustic array deployed on the vehicle, which comprises a group of acoustic receivers, such as hydrophones. As the diameter of the array is increased, the accuracy of target data gathered by the array is increased substantially. Target location, including range and azimuth, is determined through triangularization with one side of the triangle being measured by the UUV array. The longer the array side of the triangle, the more accurate is the determination of the intersection of the other two sides of the triangle, and more accurate is the determination of target course and speed.

Accordingly, there is a need for an underwater acoustic array assembly deployed on a UUV which is adapted for launch through a 21 inch torpedo tube, but has facility for expanding substantially after launch, to provide an expanded array of receivers.

SUMMARY OF THE INVENTION

An object of the invention is, therefore, to provide an underwater acoustic receiver array assembly which has facility for expanding after launch to provide an array of larger diameter, providing improved and more accurate triangularization of targets and, thereby, improved determination of target range and azimuth, and course and speed.

With the above and other objects in view, as will hereinafter appear, a feature of the present invention is the provision of an acoustic receiver array assembly, the assembly comprising an underwater vehicle having a base portion and an acoustic receiver portion. The base portion is provided with a rigid boundary wall of a cylindrical configuration defining a first diameter. The receiver portion is provided with a flexible boundary wall expandable from a generally cylindrical configuration of no more than the first diameter to an expanded configuration of a second diameter substantially larger than the first diameter, the receiver portion defining a chamber. Expansion means are disposed in the chamber and are operable to expand the receiver portion boundary wall to the second diameter. Acoustic receivers are disposed in the receiver portion and provide an acoustic receiver array which expands commensurately with the expansion of the receiver portion boundary wall.

In a preferred embodiment of the invention, the expansion means comprises mechanical means for expanding the receiver portion boundary wall and, therewith, the acoustic receiver array. In an alternative embodiment of the invention, the expansion means comprises hydraulic means for expanding the receiver portion boundary wall and, therewith, the acoustic receiver array.

The above and other features of the invention, including various novel details of construction and combinations of parts, will now be more particularly described with reference to the accompanying drawings and pointed out in the claims. It will be understood that the particular devices embodying the invention are shown by way of illustration only, and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
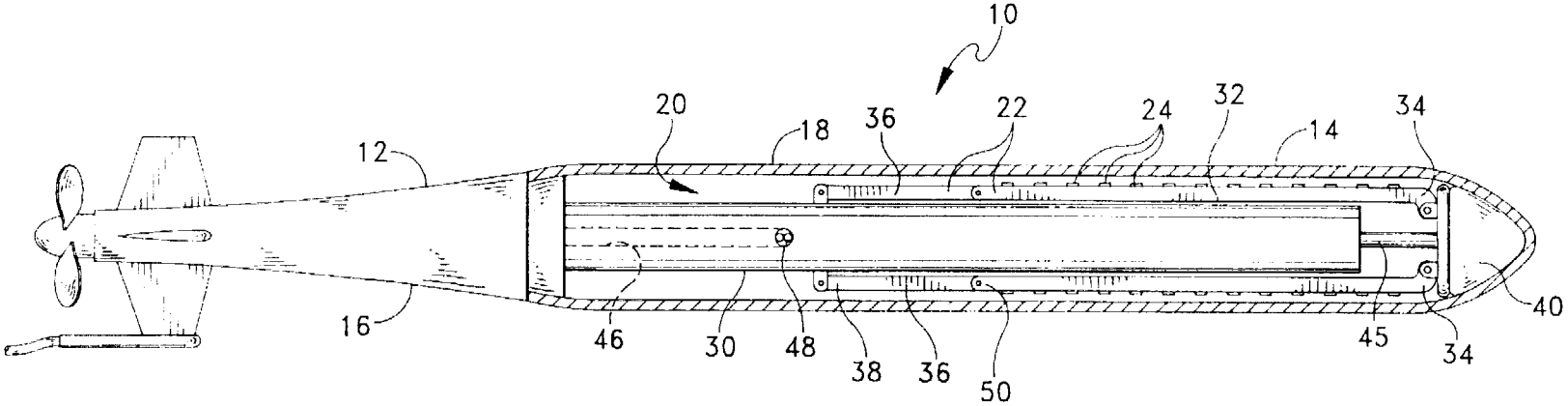
FIG. 1 is a side elevational view, partly in section, and partly diagrammatic, of one form of an acoustic receiver array assembly, illustrative of an embodiment of the invention.

Referring to FIG. 1, it will be seen that the illustrative assembly includes an unmanned underwater vehicle (UUV) 10 having a base portion 12 and an acoustic receiver portion 14. The base portion 12 is provided with a rigid boundary wall 16 of a generally conical configuration defining a largest first diameter of about 21 inches. The base portion 12 preferably is of a rigid corrosion resistant material, such as stainless steel, aluminum, or the like. The receiver portion 14 of UUV 10 is provided with a flexible boundary wall 18 expandable from a generally cylindrical configuration of no more than 21 inches in diameter to an expanded configuration (FIGS. 2 and 3) of a second diameter substantially larger than the first diameter. The receiver portion 14 defines a chamber 20.

As shown in FIGS. 1–4, an expansion means 22 is disposed in chamber 20 and is operable to expand receiver portion boundary wall 18 to the second diameter. Acoustic receivers 24 are disposed in receiver portion 14 and provide an acoustic receiver array which expands commensurately with the expansion of receiver portion boundary wall 18.

Referring to FIGS. 1–4, it will be seen that expansion means 22 preferably comprises a central post assembly 30 extending axially through chamber 20. Arms 32 are disposed in chamber 20 and are pivotally connected at a first end 34 to central post assembly 30. Struts 36 are pivotally connected at first ends 38 thereof to post assembly 30, and pivotally connected at second ends 42 thereof to arms 32.

Figure 2:
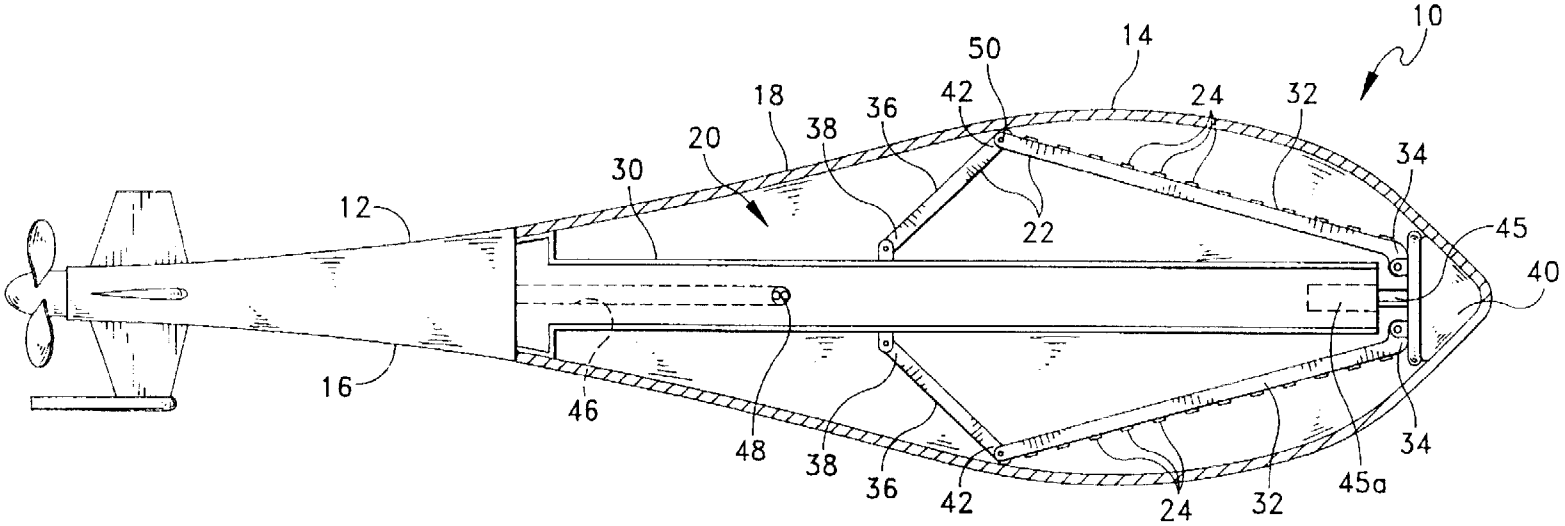
FIG. 2 is similar to FIG. 1, but shows the array in an expanded condition.
Figure 3:
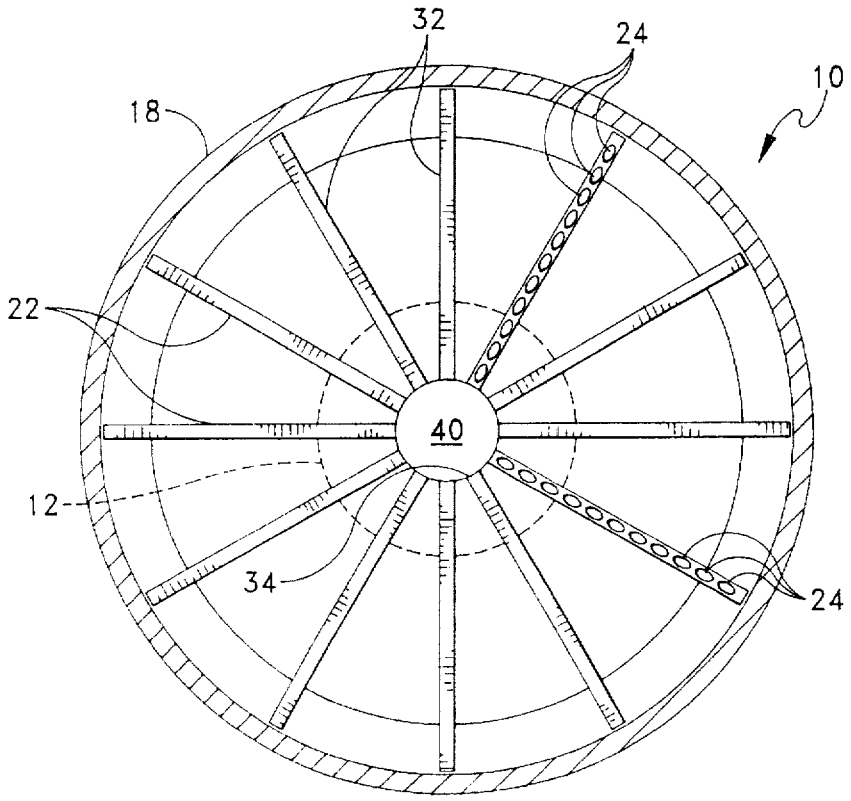
FIG. 3 is a front elevational view of the assembly of FIG. 2, shown with the outer wall in section to show internal components, and shown fully expanded.

Expansion means 22 further comprises a reciprocally movable plunger 45, for moving a nose portion 40 fixed to plunger 45, and thereby arm first ends 34, axially along central post assembly 30, to cause arms 32 to move from a first position generally adjacent central post assembly 30 (FIG. 1) to a second position wherein arms 32 extend outwardly from central post assembly 30 (FIG. 2), to cause struts 36 to move from a first position (FIG. 1) generally adjacent central post assembly 30 to a second position (FIG. 2) wherein struts 36 extend outwardly from central post assembly 30. Second ends 42 of struts 36 bear against flexible boundary wall 18 to expand wall 18 (FIGS. 2 and 3).

Plunger 45 can be actuated by a linear actuator 45*a*, such as a solenoid, hydraulic actuator, pneumatic actuator, or the like. The actuator 45*a* can be controlled via a link with the launching vehicle or control circuitry aboard the UUV 10.

Acoustic receivers 24 are mounted on arms 32. Accordingly, the array of acoustic receivers 24 expands commensurately with expansion of the receiver portion 14 of the UUV 10. Acoustic receivers 24 can be in communication with a launching vehicle by wires extending along arms 32 and/or struts 36, which join telemetry circuitry (not shown) within base portion 12.

A conduit 46 leads into chamber 20 and a valve 48 is disposed therein. The conduit 46 is in communication with a reservoir of liquid (not shown) and valve 48 is operable to admit liquid into chamber 20 to offset the outside pressure, such that arms 32 are not required to operate against outside water pressure. Alternatively, the liquid can be fuel which is pumped into a fuel tank (not shown) of UUV 10 after launch and may, in addition, be pumped into chamber 20 to increase range and/or operational life of the UUV.

Figure 4:
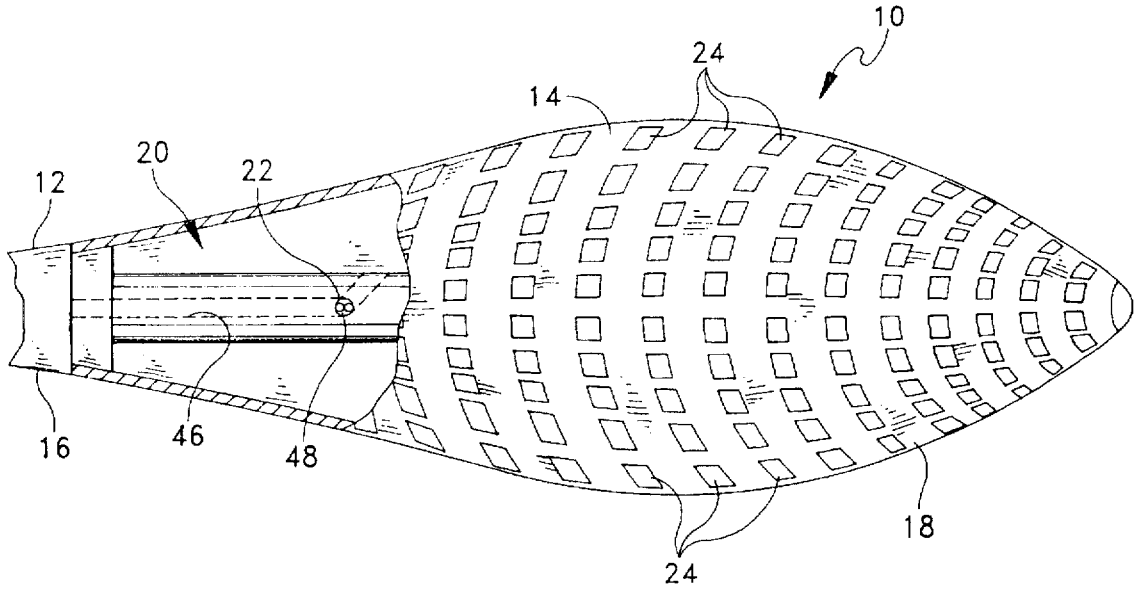
FIG. 4 is a broken away side elevational view, partly in section, of another form of assembly, illustrative of an alternative embodiment of the invention.

Referring to FIG. 4, it will be seen that in an alternative embodiment, acoustic receivers 24 are disposed on the exterior of the receiver portion boundary wall 18. In this embodiment, the conduit 46 and valve 48 admit liquid into chamber 20 to expand the boundary wall 18 to enlarge the array of acoustic receivers to well beyond the limitations of the base portion 12.

It is to be understood that the present invention is by no means limited to the particular constructions herein disclosed and shown in the drawings, but also comprises any modifications or equivalents within the scope of the claims.

What is claimed is:

1. An acoustic receiver array-assembly, said assembly comprising:

an underwater vehicle having a base portion and an acoustic receiver portion, said base portion having a rigid boundary wall of a configuration defining a first diameter, said receiver portion having a flexible boundary wall expandable from a generally cylindrical configuration of no more than said first diameter to an expanded configuration of a second diameter substantially larger than said first diameter, said receiver portion defining a chamber;

expansion means disposed in said chamber and operable to expand said receiver portion boundary wall to said second diameter; and acoustic receivers positioned in said receiver portion and providing an acoustic receiver array which expands commensurately with said expansion of said receiver portion boundary wall.

2. The assembly in accordance with claim 1 wherein said expansion means comprises:

a central post assembly extending axially through said chamber;

arms disposed in said chamber and pivotally connected at a first end to said central post assembly;

struts, each pivotally mounted at a first end on said central post and at a second end pivotally fixed to one of said arms;

means for moving said arm first ends axially along said central post to cause said arms to move from a first position generally adjacent said central post to a second position wherein said arms extend outwardly from said central post to cause said struts to move from a first position generally adjacent said central post to a second position wherein said struts extend outwardly from said central post, said struts bearing against said flexible boundary wall to expand said flexible boundary wall; and wherein said acoustic receivers are mounted on a selected one of said flexible boundary wall and said arms.

3. The assembly in accordance with claim 2, further comprising:

a nose portion;

said arm first ends being pivotally mounted proximate said nose portion; and a plunger slidable in said central post and fixed to said nose portion to slide said nose portion reciprocally of said central post.

4. The assembly in accordance with claim 3 wherein said plunger is joined to a linear actuator to cause said nose portion to slide reciprocally with respect to said central post.

5. The assembly in accordance with claim 2, further comprising a valve for admitting liquid into said chamber.

6. The assembly in accordance with claim 2 wherein a plurality of said acoustic receivers are mounted on each of said arms.

7. The assembly in accordance with claim 1 wherein said expansion means comprises a valve for admitting liquid into said chamber to cause said flexible boundary wall to expand, and wherein said acoustic receivers are mounted on said flexible boundary wall.

* * * * *